US006581692B1

(12) United States Patent
Koch et al.

(10) Patent No.: US 6,581,692 B1
(45) Date of Patent: Jun. 24, 2003

(54) MAKING UP AND BREAKING OUT OF A TUBING STRING IN A WELL WHITE MAINTAINING CONTINUOUS CIRCULATION

(76) Inventors: Kasper Koch, Nigeriastraat 53, Delft (NL), NL-2622 GB; Jacob Van Oord, Ooatblok 247, Delft (NL), NL-2612 KR; Thomas Walburgis Bakker, Tynaarlosestraat 68, Vries (NL), NL-9481 AB ( * ) Notice: Subject to any disclaimer, the term of this patent is extended or adjusted under 35 U.S.C. 154(b) by 0 days.

(21) Appl. No.: 09/830,137

(22) PCT Filed: Oct. 19, 1998

(86) PCT No.: PCT/NL98/00597

§ 371 (c)(1),
(2), (4) Date: Jun. 25, 2001

(87) PCT Pub. No.: WO00/23686

PCT Pub. Date: Apr. 27, 2000

(51) Int. Cl.[7] ..... E21B 19/16

(52) U.S. Cl. ..... 166/380; 166/75.14; 166/77.51; 166/85.1; 166/377

(58) Field of Search ..... 166/75.14, 77.51–77.53, 166/85.1, 85.4, 85.5, 377–380

(56) References Cited

U.S. PATENT DOCUMENTS 3,559,739 A 2/1971 Hutchison ..... 166/311
4,162,704 A * 7/1979 Gunther ..... 166/77.53
4,315,553 A 2/1982 Stallings ..... 175/207
4,643,259 A 2/1987 Zeringue, Jr. ..... 166/77.51
6,009,941 A * 1/2000 Haynes ..... 166/72
6,315,051 B1 11/2001 Ayling ..... 166/380

FOREIGN PATENT DOCUMENTS

WO WO 99/34089 * 7/1999

* cited by examiner

*Primary Examiner*—David Bagnell
*Assistant Examiner*—Zakiya Walker
(74) *Attorney, Agent, or Firm*—Kinney & Lange, P.A.

(57) ABSTRACT

An apparatus for making up and breaking out of a tubing string in a well includes a connector (9; 109) for connection to a tubular (1) and a main high pressure conduit (13; 113) communicating with the connector (9; 109) for allowing circulation through a tubular (1) connected thereto. Below that unit a connecting shell (17; 117) bounding a connecting chamber (18) has an upper passage (19) and a lower passage (20), a preventer (23) for separating an upper portion (24) of the connecting chamber (18) from a lower portion (25) thereof, and a back-up high pressure conduit (26) communicating with the connecting chamber (18). A pressure corresponding to the pressure in the upper portion (24) of the connecting chamber (18) is provided in at least one pressure chamber (51; 151) and exerts a force pressing a tubular (1) or the connector (9; 109) into the connecting chamber (18) against forces exerted by pressure in the connecting chamber (18).

25 Claims, 6 Drawing Sheets

MAKING UP AND BREAKING OUT OF A TUBING STRING IN A WELL WHITE MAINTAINING CONTINUOUS CIRCULATION

TECHNICAL FIELD

The invention relates to the making and breaking of tubing strings, such as drill strings and casing strings, suspended in a well drilled or being drilled in the lithosphere while continuous circulation of a fluid such as mud or foam is maintained.

BACKGROUND ART

An apparatus for connecting and disconnecting tubulars and a tubing string suspended in a well and for axially displacing that tubing string, and methods of assembling and disassembling a tubing string projecting into a well are known from U.S. Pat. No. 3,559,739. In this document a method and an apparatus for providing continuous foam circulation in wells is disclosed. To enable the circulation to continue while a tubular is connected to the tubing string or disconnected from the tubing string, a shell is provided enclosing a space where the connection is to be made or broken. When the upper end of the tubing string is opened, the flow via the top drive is taken over by a flow which enters or leaves the tubing string via the back-up conduit and the connecting chamber formed by the shell in which the connection is being made up or broken out. To allow the entry of a tubular to be added into the connecting chamber or the removal of a tubular from the connecting chamber, while maintaining the flow through the open end of the tubing string, the connecting chamber can be divided in two portions by a preventer. Thus, the flow can be maintained via the high pressure back-up conduit and the lower portion of the connecting chamber while a tubular is brought into a position in-line with the tubing string or is transported away from above the tubing string.

Other examples of such a method and such an apparatus are disclosed in International Patent Application WO 98/16716, which corresponds to U.S. Pat. No. 6,315,051, which issued to Ayling on Nov. 13, 2001 and which is incorporated herein by reference.

A problem of these methods and apparatuses is to accurately control the axial movement of and the axial forces exerted by a tubular to be connected to or being disconnected from the tubing string. Especially the stabbing forces immediately before making up a coupling and the retraction forces during the completion of breaking of a coupling are difficult to control. Inaccuracies in the control of stabbing forces can easily lead to damage to the coupling members, for instance to the threads. Apart from the costs of repair or replacement, this also entails the risk of coupling failure after the coupling has entered the well, with the associated hazards and extra operating costs.

SUMMARY OF THE INVENTION

It is an object of the present invention to provide an apparatus and a method with which control over stabbing and retraction forces is less impeded by the pressure in the connecting chamber and which allows to build up and remove the pressure in the connecting chamber quickly without loosing control over stabbing and retraction forces.

According to one aspect of the present invention, this object is achieved by providing an apparatus of the above-identified type having a pressure compensating structure for compensating axial force exerted by pressure in an upper portion of a connecting chamber pressing a tubular projecting from the upper portion of the connecting chamber in an axial direction out of the connecting chamber. The pressure compensating structure includes at least one pressure chamber and at least one pressure transfer member formed by the connector or by a separate pressure transfer member connectable to a tubular. The pressure chamber has a passage and means for sealing off the passage against the at least one pressure transfer member, the at least one pressure chamber is connected to the connecting chamber for maintaining a pressure in the at least one pressure chamber corresponding to pressure in at least the upper portion of the connecting chamber. The at least one pressure transfer member is displaceable in the at least one pressure chamber and is arranged for transferring a force axially, by pressing the tubular into the connecting chamber in reaction to pressure in the at least one pressure chamber. According to other aspects of the present invention, this object is achieved by, after lowering the tubular into the upper one of the passages, maintaining a pressure in at least one pressure chamber at a level corresponding to pressure in the upper portion of the connecting chamber, axially urging the tubular towards the connecting chamber and at least partially balancing out upward pressure exerted to the tubular by the pressure applied to the upper portion of the connecting chamber. Alternatively, according to other aspects of the present invention, this object is achieved by, after lowering the at least one connector into the connecting shell, maintaining pressure in at least one pressure chamber at a level corresponding to pressure in the upper portion of the connecting chamber, axially urging the connector towards the connecting chamber and at least partially balancing out upward pressure exerted to the connector by the pressure applied to the upper portion of the connecting chamber.

It has been found that the stabbing and retraction forces are difficult to control because the pressure in the upper portion of the chamber in the connecting shell—which can be in the order of magnitude of 500 bar—pushes the tubular to be connected or being disconnected out of the connecting chamber with a force which is substantially larger than the stabbing and retraction forces and which varies with fluctuations of the pressure in the chamber of the connecting shell which occur in operation.

The present invention provides that the tubular is pushed towards the connecting chamber by the pressure in the pressure chamber with a force which is at least essentially proportional with the force with which the tubular or the connector is pushed out of the connecting chamber by the pressure in the upper portion of the connecting chamber. Thus, the other axial forces which have to be transferred to the connector or the tubular to control the retraction or stabbing forces are substantially reduced, substantially more constant and require no or substantially less compensation for the forces generated by pressure in the connecting chamber. The devices for controlling and generating the stabbing and retraction forces and movements are substantially relieved from having to compensate the axial forces generated by the pressure in the chamber in the connecting shell. Therefore, the retraction and stabbing forces are better controllable and/or can be controlled with less powerful drives. Moreover, the pressure in the connecting chamber can be built up and removed quickly and even during stabbing or completion of breaking a coupling, without substantially disturbing the control of the stabbing or retraction forces and displacements of the tubular.

Particularly advantageous modes of carrying out the invention are set forth in the dependent claims.

Further details, objects, features and advantages of the invention are described with reference to the drawings.

MODES FOR CARRYING OUT THE INVENTION

Figure 1:
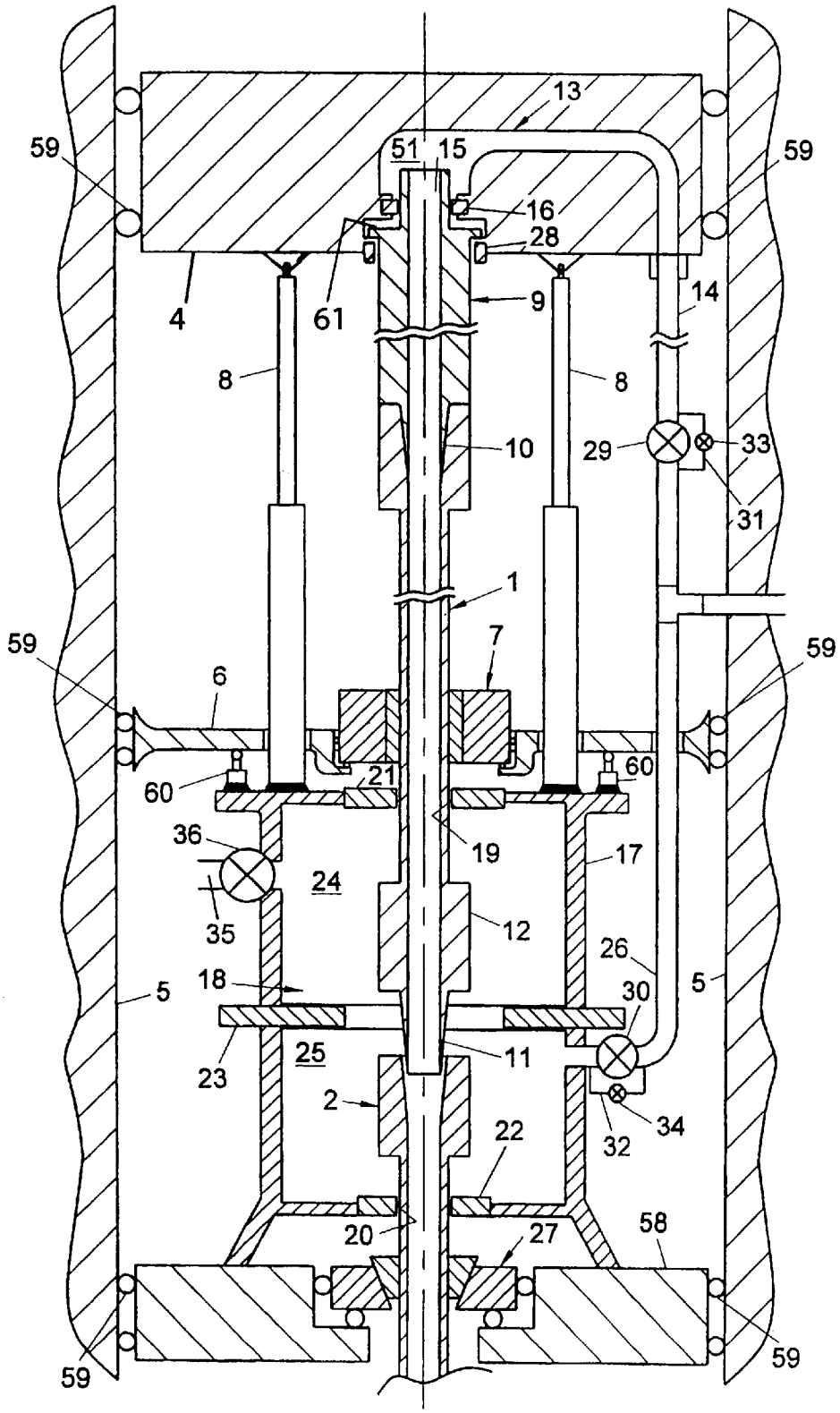
FIG. 1 is a schematic side view in cross section of an upper portion of a first example of an apparatus according to the invention.

In FIG. 1. an example of an apparatus according to the invention is shown in a stage of operation in which a tubular 1 is being stabbed into the top end of a tube string 2. This situation essentially corresponds to the stage of operation shown in FIG. 2K.

The apparatus has a suspension structure which can be of an essentially conventional construction and includes a vertical guide 5 for guiding the top end connecting unit 4, a table 6 carrying a clamp 7 which is adapted for taking up axial and rotational loads and a table 58 carrying a second clamp 27 for taking up axial and rotational loads. The connecting unit 4 and the tables 6, 58 are vertically movable along the guide 5 as is schematically represented by rollers 59. The top end connecting unit 4 is movable up and down by cylinders 8. The table 6 is movable relative to the table 58 by cylinders 60.

The top end connecting unit 4 includes a connector 9 for retaining the tubular 1 in a position axially projecting from the connector 9. To this end, the lower end 10 of the connector is formed as the lower end 11 of a male connecting member 12 of a tube coupling. The top end connecting unit 4 further includes a main high pressure conduit 13 of which a portion is formed by a high pressure hose 14 and is connected to a passage 15 through the connector 9 for allowing circulation through the tubular 1 (or any other tubular) connected to the connector 9. At the end of the main high pressure conduit 13 a seal 16 is provided for sealing off the main high pressure conduit 13.

Below the top end connecting unit 4, a connecting shell 17 is located. The connecting shell 17 bounds a connecting chamber 18 and has an upper passage and a lower passage 19, 20 on diametrically opposite sides for receiving tubulars. The openings 19, 20 are provided with seals 21, 22 for sealing off the passages 19, 20 against tubulars extending through the passages. In the connecting chamber 18 a preventer 22 for separating an upper portion 24 of the connecting chamber 18 from a lower portion 25 of the connecting chamber 18 is provided. A high pressure back-up conduit 26 communicates with the lower portion 25 of the connecting chamber 18.

The clamp 7 (not shown in FIGS. 2A–2H) is adapted and positioned for holding a tubular 1 projecting from above into the upper portion 24 of the connecting chamber 18 and can take up both axial and rotational loads. To hold the tubing string 2, a second clamp 27 for retaining a tubular projecting from below into the lower portion 25 of the connecting chamber 18 is provided. For holding the tube string 2 while the second clamp 27 is released to allow it to be moved axially along the tube string 2, a further clamp (not shown) below the clamp 27 is provided which is vertically movable as well to allow continuous axial movement of the tube string 2 while the second clamp 27 is reversed to its initial position.

The connector 9 is suspended in a special bearing 28 which allows the connector to move axially relative to the main high pressure conduit 13 between an upper extreme position and a lower extreme position defined by a flange 61. The downstream end of the main high pressure conduit 13 forms a pressure chamber 51 in which the upper end of the connector 9 is axially displaceable. If the connector 9 is axially displaced inwardly, the volume of fluid in the pressure chamber 51 is decreased. If the main high pressure conduit 13, and thereby the pressure chamber 51, is under pressure, the connector 9 is pushed outward towards the connecting chamber 18 with a force which is proportional to the pressure in the pressure chamber 51—at least as long as the connector 9 is in a position between its extreme upper and lower positions.

If the top end connecting unit 4 moves vertically in response to axial forces exerted onto the connector 9, such movements can be cancelled out by fluid displacement into and out of the chamber 51, the prevailing pressure determining the axial force exerted onto the connector 9, so that substantial changes of the force exerted onto the connector 9 are avoided. Thus, in as far as the connector 9 is in a position between its extreme upper and lower positions, the force exerted downward onto the connector is essentially independent of the position of the top end connecting unit 4.

Thus, in effect, the pressure in pressure chamber 51 urges the connector 9, of which an upper portion forms a pressure transfer member displaceable in the pressure chamber 51, in an axial direction of the tube string 2 pressing the lower end portion of the connector 9 engaging the tubular 1, in an axial direction of the tube string 2 and towards the connecting shell 17.

To achieve that the force with which the tubular 1 is pressed down by the pressure in the pressure chamber 51 closely matches the force with which tubular 1 is pressed upwards by the pressure in the connecting chamber 18, the volume decrease of fluid in the pressure chamber 51 in response to inward displacement of the tubular 1 is essentially identical to the simultaneous volume increase of fluid in the connecting chamber 18 of the connecting shell 17. The fluid displacement per unit of axial movement of the tubular 1 determines the force with which the tubular 1 is pressed outward at a given pressure in the pressure chamber 51 and the same applies to the connecting chamber 18. Furthermore, the pressures in the pressure chamber 51 and in the connecting chamber 18 are substantially equal, so that the forces exerted by the pressure in the upper portion 24 of the connecting chamber 18 are in principle cancelled out by the forces exerted by the pressure in the pressure chamber 51.

However, the fluid displacement in the upper portion 24 of the connecting chamber can be selected to be slightly larger than the simultaneous fluid displacement in the pressure chamber to provide at least a certain extent of compensation for the weight of for instance the tubular 1, top end unit 4, of the table 6 and of the clamp 7.

To ensure that the pressure in the pressure chamber 51 is indeed substantially equal to the pressure in the connecting chamber 18 when a tubular is being stabbed or disconnected, the pressure chamber 51 is arranged to communicate with the connecting chamber 18, when in operating condition. In the present example this communication is obtained via the tubular 1 that is being stabbed or disconnected and, if the preventer 23 is open, via the high pressure conduits 14, 26.

Although it would be possible to provide that one of the seals or both seals sealing the passages of the upper portion of the connecting chamber and the pressure chamber can move axially with the tubular and the connector, in the present example, a particularly efficient construction is achieved by providing that the seals 16, 21 are stationary relative to the pressure chamber 51 and, respectively, to the connecting shell 17 and that, in operating condition, the areas surrounded by the seal 21 for sealing off the upper passage 19 of the connecting shell 17 and by the seal 16 at an end of the main high pressure conduit 13 are essentially identical.

If it is desired to use a top end connecting unit with a particular connector for adding and/or removing tubulars having different cross-sectional areas at the seal sealing the upper passage 19 of the connecting shell 17, the cross-sectional area of the connector at the seal 16 of the pressure chamber 51 is preferably about equal to the average cross-sectional area of the different tubulars in the area which is at the seal sealing the upper passage 19 when a connection is made-up or being broken out.

If the area surrounded by the seal 21 of the passage 19 is slightly larger than the area surrounded by the seal 16 sealing to the connector 9 the upward forces are slightly larger than the compensating forces, which is favourable to taking into account the weight of inter alia the tubular 1, of the top end unit 4, of the table 6 and of the clamp 7.

Usually, the tubulars of a tubing string have an increased thickness at the coupling ends. As the tubing string 2 is lowered into the well or pulled out of the well, thse portions having an increased thickness pass the seals 21, 22 in the passages 19, 20 of the connecting shell 17. Furthermore, it is advantageous if the opening through the seal 21 of the passage 19 is wide when a tubular is to be inserted into the passage 19. Therefore, the seals 21, 22 for sealing off the passages 19, 20 of the connecting shell 17 are expandable from a receiving condition for allowing insertion of a tubular into the connecting chamber 18 to an expanded condition for sealing off the opening against a tubular axially projecting into the connecting chamber 18. In a retracted condition, the seals 21, 22 do not need to perform a sealing function against high pressure in the connecting chamber. Expandable seals as described are known as such and conventionally used for example for sealing off a bore hole during underbalanced drilling.

In each of the high pressure conduits 13, 14 and 26 valves 29, 30 for closing off the high pressure conduits 13, 14 and 26 are provided. The valves 29, 30 are each bypassed by a bypass 31, 32 communicating with the respective one of the high pressure conduits 13, 14 and 26. In each of the bypasses 31, 32 a bypass-valve 33, 34 (see FIG. 1) is provided. Furthermore, a low pressure conduit 35 communicates with the upper portion 24 of the connecting chamber 18. In this low pressure conduit 35 a valve 36 (see FIG. 1) is provided for closing of the low pressure conduit 35.

The valves 33, 34 in the bypasses 31, 32 are substantially smaller than the valves 29 and 30 in the high pressure conduits 13, 14 and 26. Of these valves only the valves 33, 34 in the bypasses 31, 32 are capable of being operated while a full operating pressure drop over the respective valve exists or is formed as the valve is closed. This allows to use large valves 29, 30 in the high pressure conduits 13, 14 and 26 which can be opened and closed only while no substantial pressure drop over the valve exists or is caused to exist. Such valves are substantially less expensive than large valves which can be operated at a full operating pressure drop over the valve. The bypasses 31, 32 allow to even out pressure differences before or while the valves 29, 30 in the high pressure conduits 13, 14 and 26 are operated. However, to fill and empty the connecting chamber 18 or at least the upper portion 24 thereof via the bypasses would take a long time.

This problem is avoided by filling, or emptying as the case may be, the connecting chamber 18 or at least its upper portion 24 via the low pressure conduit 35 which is of a substantially larger internal cross-section than the bypasses 31, 32. Accordingly, the bypasses 31, 32 only serve for topping up the connecting chamber up to the pressure in the respective high pressure conduit 13, 14 and 26.

Thus, filling up and emptying the connecting chamber up to a pressure which is generally in the order of magnitude of 350 bar—typically about 250–500 bar—, can be achieved very quickly without resorting to the use of expensive valves in the high pressure lines 13, 14 and 26 which are capable of being opened or closed while loaded by a pressure drop over the valve. Furthermore, opening and closing the valve in unloaded condition only provides the advantage that wear of the valves is substantially reduced.

It is observed that, while these features are particularly advantageous in combination with a pressure chamber for compensating axial forces caused by the pressure in the connecting chamber 18, because this allows to change the pressure in the connecting chamber particularly quickly without substantially disturbing the control of stabbing or retraction forces, the use of separate low pressure conduits and the features related thereto can also be used with advantage in an apparatus in which no pressure chamber and no associated pressure transfer members are provided for generating axial forces compensating the forces exerted by the pressure in the connecting chamber.

In order to allow emptying of the lower portion 25 of the connecting chamber 18 as well, a low pressure conduit 37 communicating with the lower portion 25 of the connecting chamber 18 of the connecting shell 17 is provided. This low pressure conduit 37 is provided with a valve 38 for closing off that conduit 37.

In combination with pumps 39, 40 (FIG. 2M), the valves 36, 38 in the low pressure lines 35, 37 form a flow control structure for controlling the flow through the low pressure lines 35, 37. Furthermore, a control system 41 (FIG. 2M) is provided which is operatively connected to the valves 29, 30 in the high pressure conduits 13, 14, 26, to the bypass valves 33, 34 and to the flow control structure 36, 38, 39, 40. The control system 41 is programmed for each time controlling the flow control structure 36, 38, 39, 40 to fill up at least the upper portion 24 of the connecting chamber 18 in the connecting shell 17 via the low pressure conduit 35 before opening of the bypass valve 33. Thus, it is ensured that each time only a limited volume of fluid has to pass the bypass 31 to build up the required pressure in the upper portion 24 of the connecting chamber 18.

The operation of the shown apparatus is described with reference to FIGS. 2A–2M which show one complete cycle of adding a tubular 1 to a tubing string 2.

Figure 2A:
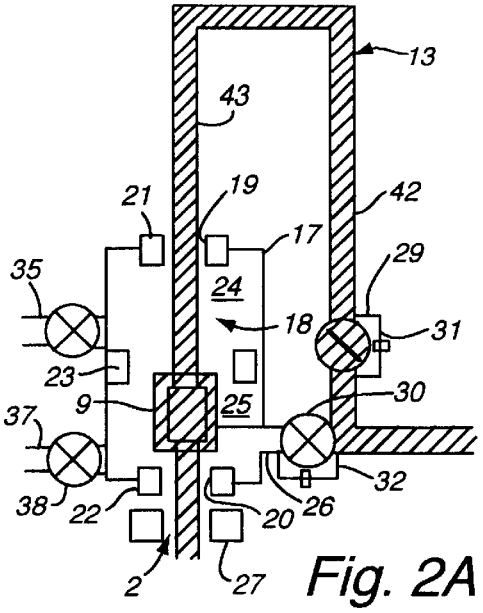
FIGS. 2A–2M are schematic side views of an apparatus according to the invention during successive stages of operation.

Before starting a cycle of connecting a tubular 1 to a tubing string 2, the apparatus is operating in a condition in which the valve 30 is closed and the valve 29 is opened so that fluid (in this example mud) passes via the hose 14, the pressure chamber 51 and the passage 15 in the connector 9 to the tube string 2, as is represented by arrows 42, 43. The connector 9 and the tubing string 2 are lowered into the upper passage 19 of the connecting shell 17 until a position at least partially within the connecting chamber 18 of the connecting shell 17 is reached. This position, in which moreover the upper end of the tubing string 2 is located in the lower portion 25 of the connecting chamber 18, is shown in FIG. 2A. As is further shown in FIG. 2A, the seals 21, 22 of the passages 19, 20 are in a non-sealing, retracted condition and the preventer 23 is open.

Figure 2B:
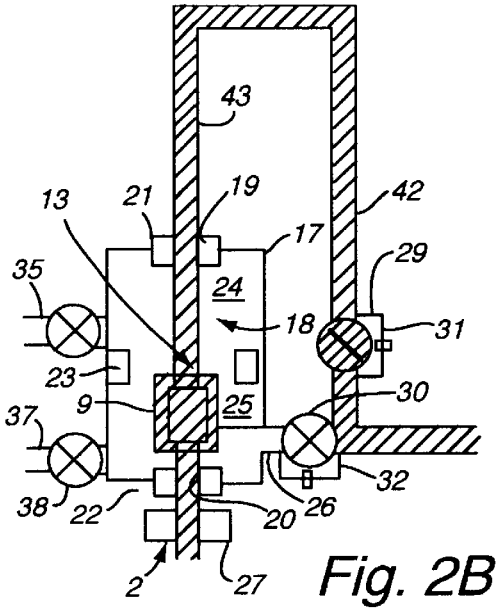

Then, the seals 21, 22 of the passages 19, 20 are expanded into a sealing, expanded condition and the lower clamp 27 is closed to engage the tubing string so that the situation shown in FIG. 2B is obtained.

Figure 2C:
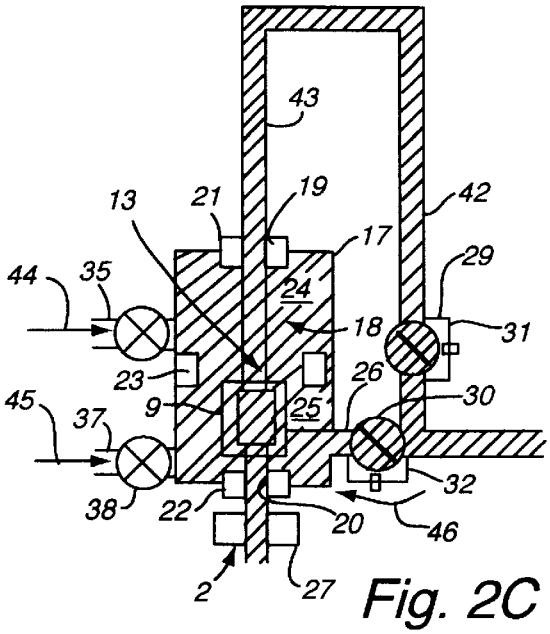

Subsequently, the connecting chamber 18 is filled with mud via the low pressure conduits 35, 37 by opening the valves 36, 38 as is represented in FIG. 2C by arrows 44, 45. After the connecting chamber 18 has been filled or has almost been filled, the valves 36, 38 are closed again to prevent high pressure from reaching the low pressure conduits, and the bypass valve 34 is opened so that the pressure in the connecting chamber 18 rises to the pressure of typically 250–500 bar prevailing in the high pressure conduits 13, 14 and 26 (arrow 46). After the pressure drop over the valve 30 in the back-up high pressure conduit 26 has been equalised, the valve 30 is opened.

Figure 2D:
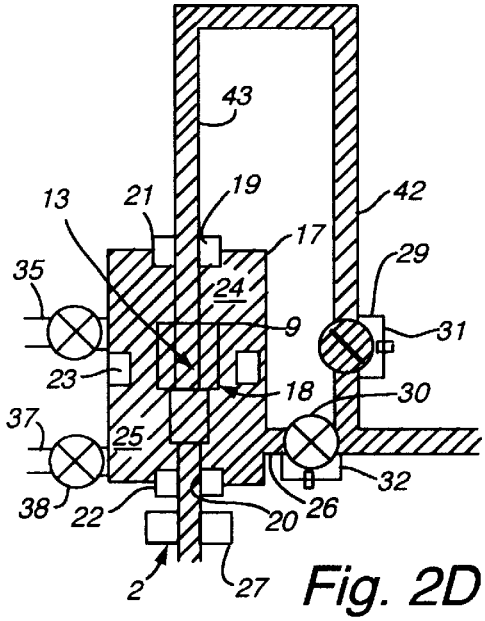
Figure 2E:
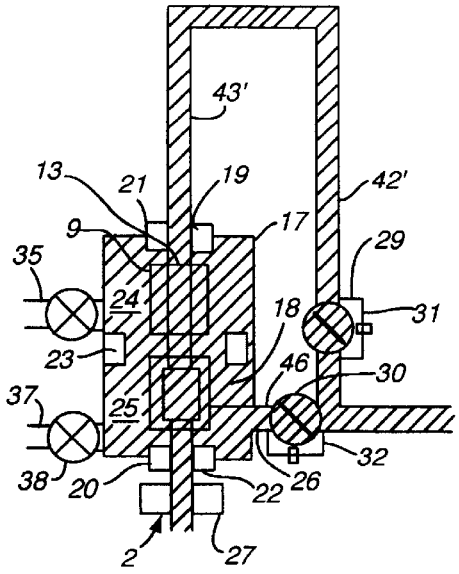

In-between, the flow of fluid through the conduit 13 and the tubing string 2 still continues as is represented by the arrows 42, 43. Then, the connector 9 is disconnected from the tubing string 2 as is shown in FIG. 2D. Since the pressure in the connecting chamber 18 is essentially equal to the pressure in the passage 15 through the connector 9 and the pressure in-hue tubing string 2 near its upper end, the flow still continues, now via the connecting chamber 18. A portion of the flow via the main high pressure conduit 13 may be replaced by through the back-up high pressure conduit 26. This portion becomes substantial at least when the connector 9 is moved further up and away from the tubing string 2 until a position above the level of the preventer 23, as is represented in FIG. 2E by the reduced length of the arrows 42', 43' and the arrow 46.

Figure 2F:
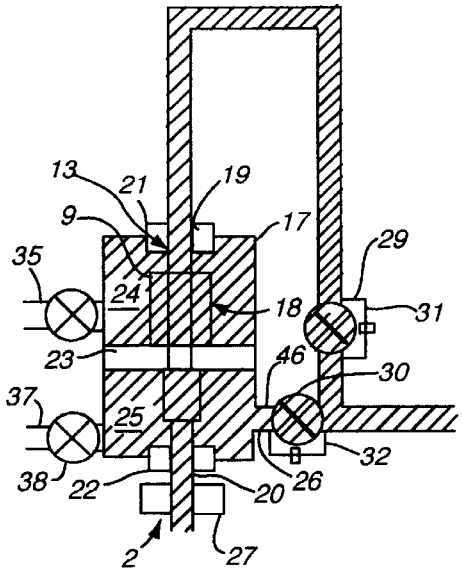
Figure 2G:
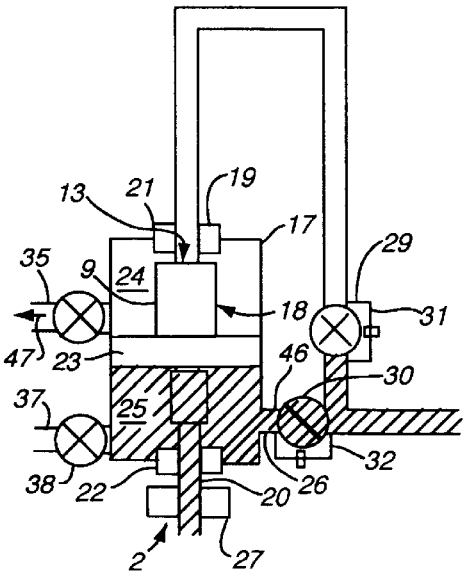

Next, as shown in FIG. 2F, the preventer 23 is closed, so that the flow through these conduits is completely replaced by a flow through the back-up high pressure conduit 26 (arrow 46).

After the preventer 23 has been closed, the valves 29, 33 in the high pressure line 14 connecting to the main high pressure conduit 13 are closed and the upper connecting chamber portion 24 drained via the low pressure conduit 35 communicating therewith by opening the valve 36 and activating the pump 33 (arrow 47).

Figure 2H:
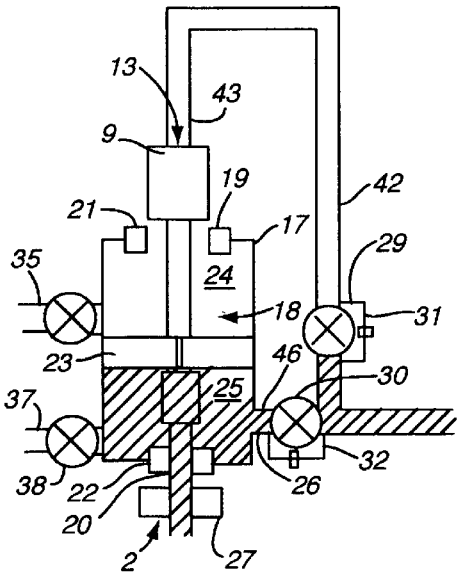

Then, the seal 21 in the upper passage 19 is retracted to facilitate withdrawal of the connector 9 from the connecting chamber 15 and the connector 9 is withdrawn from the connecting chamber 18 as is shown in FIG. 2H. In the meantime, the flow of fluid through the tubing string 2 is maintained via the back-up high pressure conduit 26 and the lower portion 25 of the connecting chamber 18 under the preventer 23 (arrow 46).

Figure 2I:
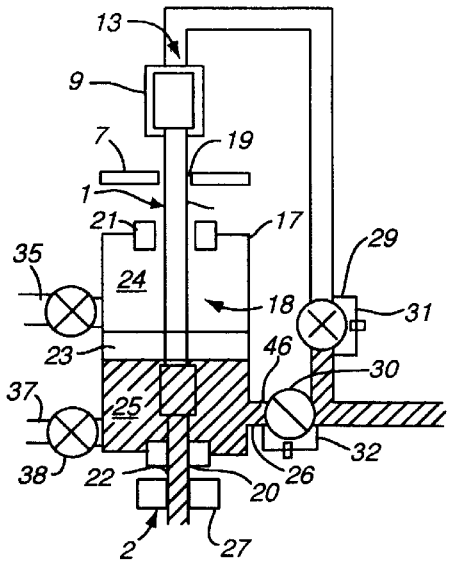

In FIG. 2I a next stage of the present method is shown in which a tubular 1 to be added to the tubing string 2 has been connected to the connector 9 and is being lowered into the connecting chamber 18. To further speed up the method, it is also possible to make use of two connectors or two top end connecting unit-which alternate each other so that each time a connector with a tubular connected thereto is directly available and no time is lost with connecting a tubular to a connector in the time between lifting the connector out of the connecting chamber and bringing the new tubular in line with tubing string 2.

Figure 2J:
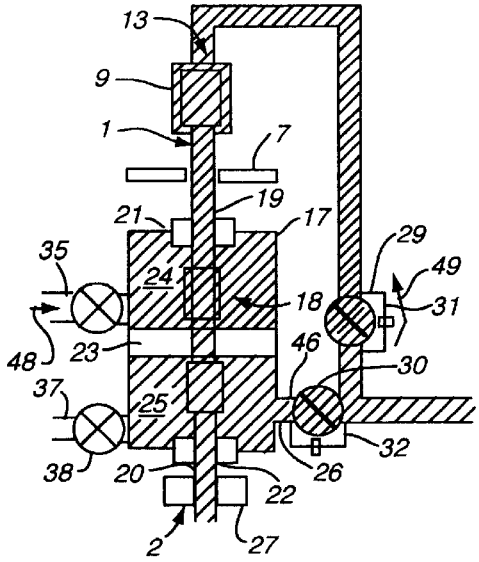

Once the coupling portion 12 at the lower end of the new tubular 1 is completely within the connecting chamber 18, the seal 21 in the upper passage 19 of the connecting shell 17 is expanded to seal against the stem of the new tubular 1 (FIG. 2J). As is also shown in FIG. 2J, the upper portion 24 of the connecting chamber 18 is filled again via the low pressure conduit 35 communicating therewith by activating the pump 39 (arrow 48). The valve 36 has been left open since the draining of the upper portion 24 of the connecting chamber 18. It is observed that the ends of the low pressure conduit 35, 37 remote from the connecting chamber 18 need only communicate with a reservoir of sufficient size to temporarily store fluid drained from the connecting chamber 18. If such a reservoir is positioned at a suitable level, the pumps 39, 40 need only be operated for either draining or filling the connecting chamber, the opposite flow being obtainable by simply letting the fluid flow back down. After the connecting chamber 18 has been filled sufficiently, the valve 36 is closed.

Then, the main high pressure conduit 13 (or another one of the high pressure conduits if a different connector connected to a different high pressure branch is used) communicating with the new tubular 1 and the upper portion 24 of the connecting chamber 18 is brought under pressure by opening the valve 33 in the bypass 31 around the valve 29 in the high pressure hose 14 in-line with the main high pressure conduit 13 (arrow 49). As was discussed, the upward force exerted onto the new tubular 1 by the pressure in the connecting chamber 18 is compensated by the pressure in the pressure chamber 51 pushing the connector 9, and thereby the tubular 1 connected thereto, downward.

Figure 2K:
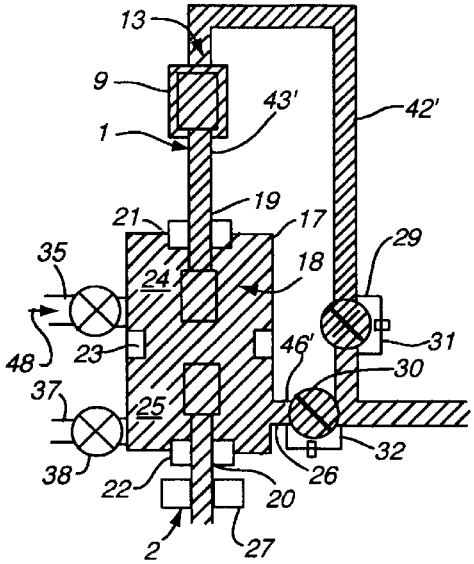

Then, as is shown in FIG. 2K, the preventer 23 and the valve 29 in the high pressure hose 14 in-line with the main high pressure conduit 13 are opened. Since the pressures on opposite sides of the preventer 23 are equalised each time before the preventer 23 is opened, the high operating pressure is applied to the preventer only while the preventer is closed and not while it is being opened or closed. Therefore, the preventer can be of a relatively simple design and wear of the preventer is reduced.

Thus, a portion of the fluid flow is again lead via the high pressure hose 14 and the main high pressure conduit 13 (arrows 42', 43') and the flow via the high pressure back-up conduit 26 is reduced accordingly (arrow 46').

Figure 2L:
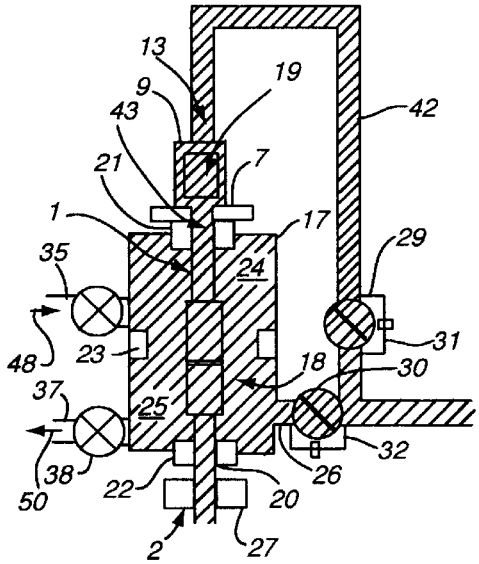
Figure 2M:
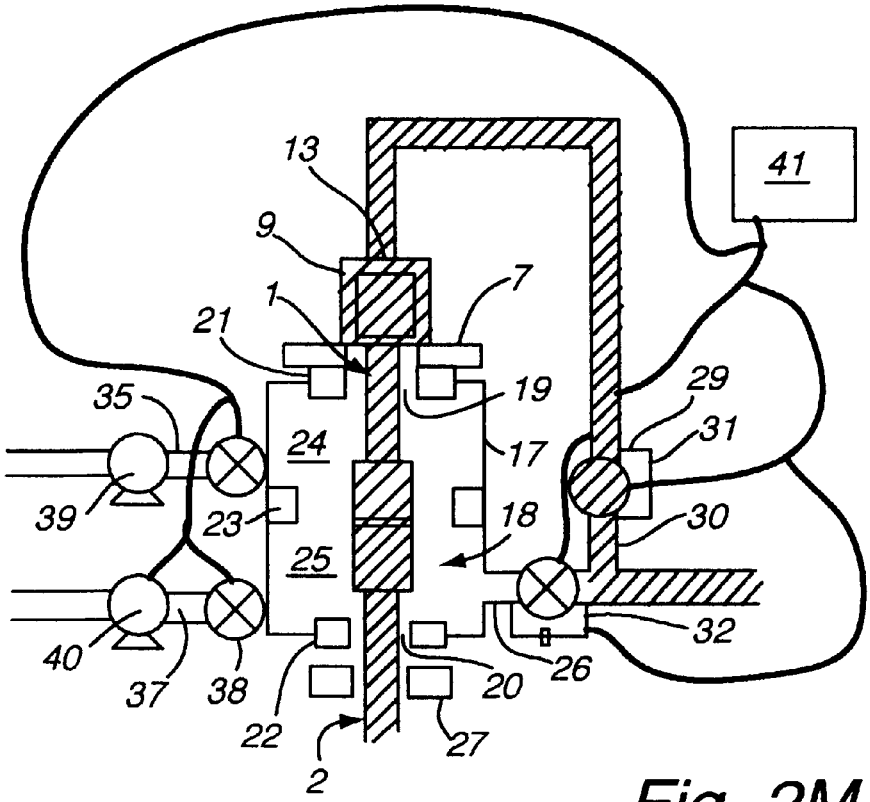

Subsequently, the top end connecting unit 4 is lowered until the lower end of the new tubular 1 is closely above the upper end of the tubing string 2 (FIG. 1). In this position, the tubular 1 is clamped by the clamp 7 and slightly lifted from its lowest position relative to the top end connecting unit 4 by lowering the top end connecting unit slightly further. Axial movement of the new tubular 1 is now controlled by the axial movement of the clamp 7, the top end connecting unit 4 merely following such movements to keep the connector 9 from reaching its extreme upper and lower positions relative to the top end connecting unit. The clamp 7 accurately controls the axial stabbing force applied to the tubular 1 as it is lowered and engages the upper end of the tubing string 2 (FIG. 2L). The axial forces which have to be exerted by the clamp 7 and by the cylinders 60 for moving the table 6 carrying the clamp 7 are limited because the axial forces exerted by the pressure in the connecting chamber 18 and in the main high pressure conduit 13 essentially cancel each other out, even if these pressures would fluctuate erratically (any substantial pressure differences being prevented by communication between the connecting chamber 18 and the main high pressure conduit 13 via the tubular 1).

Once the connection between the tubular 1 and the tubing string 2 has been made up, generally by also twisting the tubular 1 relative to the tubing string 2 which preferably has continued to rotate and to be lowered, the fluid flow, which has not been interrupted, again runs entirely via the main high pressure conduit 13 (arrows 42, 43) and the valve 30 in the high pressure back-up conduit 26 as well as its bypass valve 34 are closed. Then, the connecting chamber 18 is drained by opening the valve 38 in the low pressure conduit connected to the lower portion of the connecting chamber 18 (arrow 50).

The clamps 7, are released and after the connecting chamber 18 has been drained, the seals 21, 22 in the passages 19, 20 in the connecting shell 17 are retracted again to allow continuation of the lowering of the tubing string 2.

Since the fluid is removed from the connecting chamber 18 after make-up of the connection and before the connection leaves the connecting chamber 18, the lower seal need not fulfil any sealing function while the tubing string 2 is being lowered and portions of different thickness pass the lower passage 20 in the connecting shell 17.

However, especially if the tubing string is reasonably smooth on its outside, it is preferred to leave fluid in the connecting chamber 18 and to pass the connection between successive tubulars through the lower seal 22 of the connecting shell while this seal seals against the tubing string 2. Thus, the need of draining and refilling the connecting chamber 18 is obviated. Seals for sealing against pipe sections and connections having a different diameter, both axially passing through, are commercially available.

Figure 3:
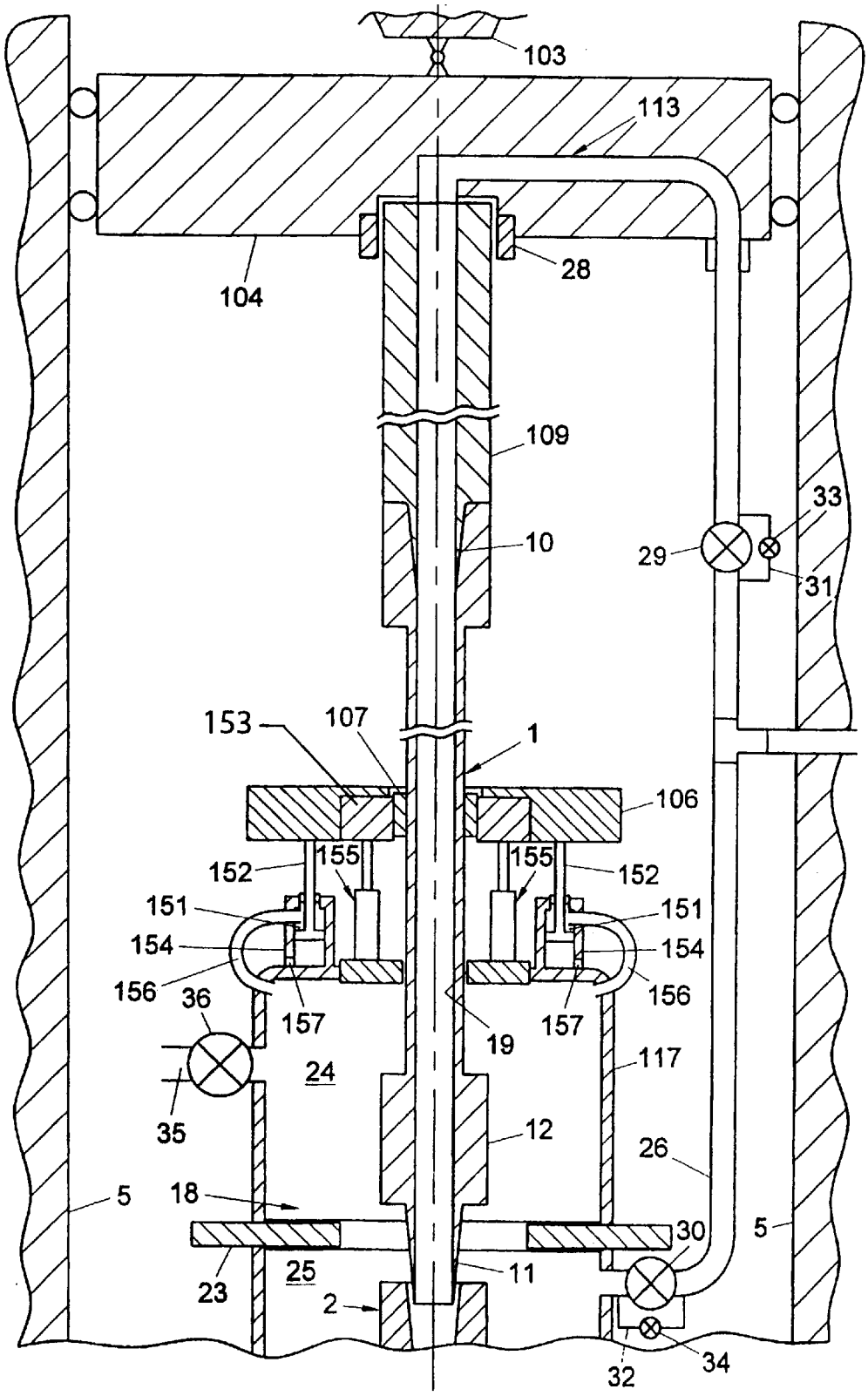
FIG. 3 is a schematic side view in cross section of an upper portion of a second example an apparatus according to the invention.

In FIG. 3 a presently most preferred embodiment of the present invention is shown. In as far as the design shown in FIG. 3 essentially corresponds to the design shown in FIG. 1, mutually identical reference numerals are used.

In the apparatus shown in FIG. 3, the first engagement structure is formed by a clamp 107 adapted for transmitting both axial forces and a torque to the tubular 1. Accordingly, the main high pressure conduit 113 is of a different design without a pressure chamber into which the connector can move axially. The top end connecting unit 104, through which the main high pressure conduit 113 extends, is suspended from a hoist 103. To allow tube sections to be connected to or disconnected from the fluid circuit while fluid is being circulated through the top end of the tube string 2, preferably two or more top end connecting units 104 and a device for laterally moving the top end connecting units 104 are provided as is described in international patent application PCT/NL97/00726, which corresponds to U.S. Pat. No. 6,435,280 and which issued to Van Wechem et al. on Aug. 20, 2002 and which is incorporated herein by reference.

Pressure transfer members in the form of pistons 152 and a carrier table 153 are connected to the clamp 107 for transferring forces compensating the forces exerted by the pressure in the connecting chamber 18 in a connecting shell 117 to the clamp 107.

The clamp 107 is located for engaging the tubular 1 between the connecting chamber 18 and the top end connecting unit 104.

In operation, the first engagement structure engages the tubular between the connecting shell 117 and the top end connecting unit 4. This provides the advantage that the tubular 1 is substantially less susceptible to buckling under the axial compression loads exerted thereto by the pressures in the connecting chamber 18 and by the clamp 107. This is of particular advantage when each time not a single tubular, but a subassembly of two or more tubulars is added to the string 2.

In the present apparatus the likelihood of buckling is practically non-existent because the clamp 107 is located for engaging the tubular closely adjacent the connecting chamber 18. The drives for driving rotation of the clamp 107 are not shown in FIG. 3. For these features, reference is made to international patent application PCT/NL 97/00727.

In this example, two pressure chambers 151 are formed by cylinder chambers 151 in pressure cylinders 154. Since the pressure cylinders 154 are directly connected to the connecting shell 117, the reactive forces compensating the upward forces generated by the pressure in the connecting chamber 18 need not be transferred via a trajectory involving other parts of the apparatus.

The pressure in the pressure chambers 151, which have venting openings 157 below the pistons 155, urges the pistons 152 displaceable in the pressure chambers 151 in an axial direction of the tube string 2 pressing the clamp 107 engaging the tubular 1 in an axial direction of the tube string 2 towards the connecting shell 117 and thereby compensates the forces exerted by the pressure in the connecting chamber 18.

To control the axial displacements of the tubular 1 and the stabbing and retraction forces, a separate set of operating cylinders 155 is provided, which are mounted between the carrier table 153 and the connecting shell 117 as well. The housings of the cylinders 155 are not mounted to the seals 21, but, as seen in the present representation, behind the seals to the housing of the connecting shell 117. A table 106 supports the carrier table 153 carrying the clamp 107 and the connecting shell relative to the suspension structure 5.

In principle, the pressure in the pressure chambers 151 could be different form the pressure in the connecting chamber 18, for instance by being in a proportional relation therewith. In the present apparatus, the pressure chambers 151 are arranged to communicate with the connecting chamber 18 via conduits 156 directly connecting the pressure chambers 151 with the upper portion 24 of the connecting chamber 18. Thus, it is ensured in a particularly simple manner that the pressure in the pressure chambers 151 is substantially equal to the pressure in at least the upper portion 24 of the connecting chamber 18.

It is evident to the skilled person that many modifications can be made to the example shown above without departing from the scope of the invention. For instance, separate clamps can be used for taking up rotational and axial loads, the clamps or alternative clamps can be located within the connecting shell instead of outside the connecting shell, pressure differences over the main valves can be equalised by opening the valves in a special manner or by opening special ports in the valve bodies, and the seal at the end of the main high pressure conduit can be positioned to seal against the stem of a tubular.

What is claimed is:

1. An apparatus for connecting and disconnecting tubulars and a tubing string suspended in a well and for axially displacing that tubing string, comprising:

a suspension structure;

a top end connecting unit including at least one connector for connection to a tubular axially projecting from said at least one connector, and at least one main high pressure conduit communicating with said at least one connector for providing circulation through a tubular connected to said at least one connector;

a connecting shell bounding a connecting chamber, said connecting shell having an upper passage and a lower passage for receiving tubulars, means for sealing off said passages against tubulars extending through said passages, a preventer for separating an upper portion of said connecting chamber from a lower portion of said connecting chamber, and a back-up high pressure conduit communicating with said lower portion of said connecting chamber;

a first engagement structure for engaging a tubular projecting from above into said upper portion of said connecting chamber, said first engagement structure being carried by said suspension structure; and a second engagement structure for engaging a tubular projecting from below into said lower portion of said connecting chamber;

wherein at least said top end connecting unit is movable up and down relative to said suspension structure; and said connecting shell is located below said top end connecting unit;

characterized by a pressure compensating structure for compensating axial force exerted by pressure in said upper portion of said connecting chamber pressing a tubular projecting from said upper portion of said connecting chamber in an axial direction out of said connecting chamber, said pressure compensating structure including at least one pressure chamber and at least one pressure transfer member formed by the connector or by a separate pressure transfer member connectable to a tubular;

said pressure chamber having a passage and means for sealing off said passage against said at least one pressure transfer member, said at least one pressure chamber being connected to said connecting chamber for maintaining a pressure in said at least one pressure chamber corresponding to pressure in at least said upper portion of said connecting chamber, and said at least one pressure transfer member being displaceable in said at least one pressure chamber and arranged for transferring a force axially pressing the tubular into said connecting chamber in reaction to pressure in said at least one pressure chamber.

2. An apparatus according to claim 1, wherein said at least one pressure chamber is arranged to communicate with said connecting chamber, when in operating condition.

3. An apparatus according to claim 1, wherein said at least one pressure transfer member is connected to said first engagement structure, said first engagement structure being located for engaging said tubular between said connecting chamber and said top end connecting unit.

4. An apparatus according to claim 1, wherein said at least one pressure transfer member is connected to said first engagement structure, said first engagement structure being located for engaging said tubular closely adjacent said connecting chamber.

5. An apparatus according to claim 1, wherein said at least one pressure chamber has a housing directly connected to said connecting shell.

6. An apparatus according to claim 1, wherein, in operating condition, the displacement of fluid in said at least one pressure chamber in response to a tubular projecting from said at least one connector into said connecting chamber being axially displaced relative to said connecting chamber and to said at least one pressure chamber is of essentially the same volume as the simultaneous displacement of fluid in said connecting chamber caused by said movement of said tubular.

7. An apparatus according to claim 6, wherein, in operating condition, the displacement of fluid in said at least one pressure chamber in response to a tubular projecting from said at least one connector into said connecting chamber being axially displaced relative to said connecting chamber and to said at least one pressure chamber is smaller than the simultaneous displacement of fluid in said connecting chamber caused by said movement of said tubular, the difference between said fluid displacements being adapted to compensate for weight of said tubular and of equipment being displaced therewith.

8. An apparatus according to claim 1, wherein, in operating condition, said means for sealing off said upper passage of said connecting shell surround an area urged in axial direction by said fluid pressure, and said means for sealing off said passage of said at least one pressure chamber surround at least one other area urged in axial direction by said fluid pressure, said area and said at least one other area each having an aggregated size in axial projection, said aggregated sizes being essentially identical to each other.

9. An apparatus according to claim 8, wherein, in operating condition, the size of said area surrounded by said means for sealing off said upper passage of said connecting shell is larger than the aggregated size of said at least one area surrounded by said means for sealing off said passage of said at least one pressure chamber, the difference between said sizes being adapted to compensate for weight of said tubular and equipment being displaced therewith.

10. An apparatus according to claim 1, wherein said seals for sealing off said passages of said connecting shell are expandable from a receiving condition for allowing insertion of a tubular into said connecting chamber into an expanded condition for sealing off said opening against a tubular axially projecting into said connecting chamber.

11. An apparatus according to claim 1, further comprising a valve in each of said high pressure conduits for closing off said high pressure conduits, bypasses communicating with each one of said high pressure conduits and bypassing said respective valves in said high pressure conduits, a bypass-valve in each of said bypasses, and a low pressure conduit communicating with said upper portion of said connecting chamber.

12. An apparatus according to claim 11, further comprising a low pressure conduit communicating with said lower portion of said connecting chamber of said connecting shell.

13. An apparatus according to claim 11, further comprising a flow control structure for controlling the flow through said low pressure conduit and a control system operatively connected to said valves in said high pressure conduits communicating with said at least one connector and with said lower portion of said connecting chamber of said connecting shell, to said valves in said bypass conduits and to said flow control structure, said control system being programmed for each time controlling said flow control structure to fill up at least said upper portion of said connecting chamber in said connecting shell via said low pressure conduit before opening at least one of said bypass valves.

14. A method of assembling a tubing string projecting into a well, including the steps of:

providing a top end connecting unit including at least one connector for connection to a tubular axially projecting from said at least one connector, and at least one main high pressure conduit communicating with said at least one connector for allowing circulation through a tubular connected to said at least one connector;

providing a connecting shell below said top end connecting unit, said shell bounding a connecting chamber and having an upper passage and a lower passage coaxial therewith for receiving tubulars, seals for sealing off said passages against tubulars extending through said passages, a preventer for separating an upper portion of said connecting chamber from a lower portion of said connecting chamber, and a back-up high pressure conduit communicating with said lower portion of said connecting chamber;

lowering said at least one connector and a tubing string connected thereto into said connecting shell until a position at least partially within said connecting chamber of said connecting shell;

disconnecting said at least one connector from said tubing string;

lifting said at least one connector into a position in which a lowest portion thereof is located above said preventer;

closing off said preventer;

removing feeding pressure from said at least one main high pressure conduit and from said upper portion of said connecting chamber and withdrawing said at least one connector from said connecting chamber;

connecting a tubular to one of said connectors and lowering said tubular into said upper passage;

bringing one of said at least one main high pressure conduits in communicating with said tubular and said upper portion of said connecting chamber under pressure and opening said preventer; and further lowering said tubular and making up a connection between said tubular and said tubing string;

characterized in that, after said step of lowering said tubular into said upper passage, pressure in at least one pressure chamber is maintained at a level corresponding to pressure in said upper portion connecting chamber, axially urging said tubular towards said connecting chamber and at least partially balancing out upward pressure exerted to said tubular towards said connecting chamber and at least partially balancing out upward pressure exerted to said tubular by the pressure applied to said upper portion of said connecting chamber.

15. A method according to claim 14, wherein said pressure in said at least one pressure chamber urges at least one pressure transfer member displaceable in said at least one pressure chamber in an axial direction of said tube string pressing said tubular in an axial direction of said tubing string towards said connecting shell.

16. A method according to claim 15, wherein axial forces in the direction of said tubing string are exerted onto said tubular in a position between said connecting shell and said top end connecting unit.

17. A method according to claim 15, wherein axial forces in the direction of said tubing string are exerted onto said tubular in a position closely adjacent said connecting shell.

18. A method according to claim 14, wherein axial displacement of said tubular relative to said at least one pressure chamber and relative to said upper portion of said connecting chamber is associated to a fluid displacement in said upper portion of said connecting chamber and a fluid displacement of essentially the same volume in said at least one pressure chamber.

19. A method according to claim 18, wherein the fluid displacement in said upper portion of said connecting chamber associated to axial displacement of said tubular relative to said at least one pressure chamber and relative to said upper portion of said connection chamber is larger than the simultaneous fluid displacement in said at least one pressure chamber, the difference between said displacements being adapted to compensate for weight of said tubular and equipment being displaced therewith.

20. A method according to claim 14, wherein said pressure in said at least one pressure chamber is controlled by communication with said upper portion of said chamber in said connecting shell.

21. A method according to claim 14, wherein pressures on opposite sides of said preventer are equalized before said preventer is opened.

22. A method according to claim 14, wherein fluid is left in said connecting chamber after the making or breaking of said connection and the lower passage seals against said tubing string as connections pass through said lower passage.

23. A method according to claim 14, wherein, each time at least said upper portion of said connecting chamber is filled, fluid is transferred into said connecting chamber via a low pressure conduit, subsequently said low pressure conduit is closed off and subsequently said connecting chamber is brought under a higher operating pressure by opening a valve in a bypass of said at least one main high pressure conduit communicating with said connecting chamber.

24. A method according to claim 23, wherein each time fluid is removed from said connecting chamber, valves of high pressure conduits communicating with said connecting chamber are closed, subsequently a low pressure conduit communicating with said connecting chamber is opened and fluid in said connecting chamber is removed via said low pressure conduit.

25. A method of disassembling a tubing string projecting into a well, including the steps of:

providing a top end connecting unit including at least one connector for connection to a tubular axially projecting from said at least one connector for allowing circulation through a tubular connected to said at least one connector;

providing a connecting shell below said top end connecting unit, said shell bounding a connecting chamber and having an upper passage and a lower passage coaxial therewith for receiving tubulars, seals for sealing off said passages against tubulars extending through said passages, a preventer for separating an upper portion of said connecting chamber from a lower portion of said connecting chamber, and a back-up high pressure conduit communicating with said lower portion of said connecting chamber;

lowering said at least one connector into said connecting shell until a position at least partially within said connecting chamber of said connecting shell;

bringing one of said at least one main high pressure conduit in communication with said connector under pressure and opening said preventer;

further lowering said connector and making up a connection between said tubular and said tubing string;

connecting said at least one connector to said tubing string (2);

lifting said at least one connector and a tubular connected thereto into a position in which a lowest portion of said tubular is located in said lower portion of said connecting chamber;

breaking up a connection between said tubular and said tubing string;

lifting said at least one connector and a tubular connected thereto into a position in which a lowest portion of said tubular is located in said upper portion of said connecting chamber and above said preventer;

closing off said preventer;

removing feeding pressure from said at least one main high pressure conduit and from said upper portion of said connecting chamber and withdrawing said tubular from said connecting chamber;

characterized in that, after said step of lowering said at least one connector into said connecting shell, pressure in at least one pressure chamber is maintained at a level corresponding to pressure in said upper portion of said connecting chamber, axially urging said connector towards said connecting chamber and at least partially balancing out upward pressure exerted to said connector by the pressure applied to said upper portion of said connecting chamber.

* * * * *

UNITED STATES PATENT AND TRADEMARK OFFICE

CERTIFICATE OF CORRECTION

PATENT NO. : 6,581,692 B1
DATED : June 24, 2003
INVENTOR(S) : Kasper Koch et al.

It is certified that error appears in the above-identified patent and that said Letters Patent is hereby corrected as shown below:

Column 9,
Line 53, delete “PCT/NL97/00726”, insert -- PCT/NL97/00727 --

Column 12,
Line 34, delete “seals”, insert -- means --

Column 13,
Line 28, delete “said connector”, insert -- said at least one connector --
Line 31, delete “conduits in communicating”, insert -- conduit in communication --
Line 51, delete “tube”, insert -- tubing --

Column 14,
Line 20, delete “said”, insert -- the --
Line 63, delete “(2),”

Signed and Sealed this

Twenty-third Day of November, 2004

JON W. DUDAS
*Director of the United States Patent and Trademark Office*